US010493493B2

(12) United States Patent
Wei et al.

(10) Patent No.: US 10,493,493 B2
(45) Date of Patent: Dec. 3, 2019

(54) ROBOT FOR SORTING

(71) Applicants: Beijing Jingdong Shangke Information Technology Co., Ltd., Beijing (CN); JD.com American Technologies Corporation, Santa Clara, CA (US)

(72) Inventors: Zihang Wei, Santa Clara, CA (US); Hui Cheng, Bridgewater, NJ (US)

(73) Assignees: BEIJING JINGDONG SHANGKE INFO. TECHNOLOGY CO., LTD, Beijing (CN); JD.COM AMERICAN TECHNOLOGIES CORPORATION, Santa Clara, CA (US)

( * ) Notice: Subject to any disclaimer, the term of this patent is extended or adjusted under 35 U.S.C. 154(b) by 0 days.

(21) Appl. No.: 15/911,345

(22) Filed: Mar. 5, 2018

(65) Prior Publication Data

US 2019/0270121 A1 Sep. 5, 2019

(51) Int. Cl.
*B07C 3/02* (2006.01)
*B07C 3/00* (2006.01)

(52) U.S. Cl.
CPC ..... *B07C 3/02* (2013.01); *B07C 3/008* (2013.01)

(58) Field of Classification Search
CPC ..... B07C 3/02; B07C 3/008
USPC ..... 209/654
See application file for complete search history.

(56) References Cited

U.S. PATENT DOCUMENTS

| | | | | | |
|---|---|---|---|---|---|
| 2,897,746 | A * | 8/1959 | Hilgers | A47J 37/046 | 99/443 R |
| 4,312,460 | A * | 1/1982 | Boettcher | G07F 11/42 | 221/242 |
| 4,503,502 | A * | 3/1985 | Chapin | A47J 27/14 | 700/90 |
| 4,999,943 | A * | 3/1991 | Crabtree | A01K 97/06 | 43/54.1 |
| 5,799,787 | A * | 9/1998 | Talbot | B25H 3/025 | 206/315.11 |
| 6,606,841 | B1 * | 8/2003 | Germunson | B65B 5/068 | 294/27.1 |
| 2004/0200853 | A1 * | 10/2004 | Prichard | G07F 5/26 | 221/69 |
| 2009/0255854 | A1 * | 10/2009 | Bazinet | B03C 1/30 | 209/2 |

(Continued)

FOREIGN PATENT DOCUMENTS

| | | | |
|---|---|---|---|
| CN | 204324022 | * | 12/2014 |
| CN | 208476817 | * | 5/2019 |

*Primary Examiner* — Terrell H Matthews
(74) *Attorney, Agent, or Firm* — Dinsmore & Shohl, LLP

(57) ABSTRACT

Embodiments of the present disclosure disclose a robot for sorting. A specific embodiment of the robot for sorting may comprise: at least one layer of trays; wherein an axial center of the tray is provided with a shaft; the tray is provided with a first slot that has an openable first door; an end of the tray extends upwardly to form a tray wall; a space separator for partitioning a storage bin is provided along the shaft of the tray till the tray wall; and the space separator is in rotary connection to the shaft of the tray and is rotatable about the shaft of the tray. This embodiment may adjust the size of the storage bin and the number of items placed in the storage bin, and by outputting the item through the openable first door, the output efficiency of the item in the storage bin is improved.

20 Claims, 3 Drawing Sheets

(56) References Cited

U.S. PATENT DOCUMENTS

2012/0267283 A1* 10/2012 Hall ..... A01K 97/06
206/557

* cited by examiner

ROBOT FOR SORTING

TECHNICAL FIELD

Embodiments of the present disclosure relate to the technical field of fulfillment, specifically to the technical field of warehouse fulfillment, and more particularly to a robot for sorting.

BACKGROUND

In a warehouse, products in customer orders are usually retrieved and transported with typical trays placed on a trailer. However, these traditional trays are limited by the number of items, the size of each storage bin, response time of a worker, and human-caused mismatching, such that after each sorting, a secondary sorting is still necessary to ensure that the items in the orders are correctly sent to respective customers.

SUMMARY

Embodiments of the present disclosure provide a robot for sorting.

An embodiment of the present disclosure provides a robot for sorting, wherein the robot comprising: at least one layer of trays; the tray at each layer comprises: a shaft provided at an axial center of the tray; a first slot provided at the tray, in which first slot an openable first door is provided; an end of the tray extends upwardly to form a tray wall; at least one space separator for partitioning a storage bin is provided along the shaft of the tray till the tray wall; and the space separator is in rotary connection to the shaft of the tray and is rotatable about the shaft of the tray.

In some embodiments, the shaft of the tray is a first tray servo system, and a shaft of the first tray servo system drives the tray to rotate about the shaft of the tray.

In some embodiments, the space separator is provided with a driving motor; a gearwheel is provided on a shaft of the driving motor; when the shaft of the driving motor drives the gearwheel to rotate, the gearwheel is engaged with a gear ring preset on the tray wall to drive the space separator to rotate about the shaft of the tray.

In some embodiments, the openable first door is provided with a door servo motor that controls an openness of the first door.

In some embodiments, an output of the first door of the tray at a bottom layer in the at least one layer of trays corresponds to a packaging machine.

In some embodiments, an output of the first door of the tray at the bottom layer in the at least one layer of trays corresponds to an inlet of a single packaging machine; or through rotation of the tray at the bottom layer in the at least one layer of trays, the output of the first door of the tray at the bottom layer corresponds to inlets of different packaging machines.

In some embodiments, the robot further comprises: a tray cover concentric with the shaft of the tray, wherein the tray cover is disposed above a tray at a top layer in the at least one layer of trays; an axial center of the tray cover is provided with a second tray servo system; a shaft of the second tray servo system drives the tray cover to rotate about the axial center of the tray cover; the tray cover is provided with a second slot in which an openable second door is provided.

In some embodiments, the robot identifies an input item by a detecting and identifying device, and rotates, through the first tray servo system located at each layer of the tray on an input path, the first door of the tray at each layer till above a predetermined storage bin, and controls opening and closing of the first door of the tray at each layer located on the input path to transport the inputted item to the predetermined storage bin.

In some embodiments, the robot identifies an input item by a detecting and identifying device, and rotates, via the first tray servo system of the tray at each layer on the input path and the second tray servo system of the tray cover, the first door of the tray at each layer and the second door of the tray cover till above the predetermined storage bin, respectively, and controls opening and closing of the first door of the tray at each layer on the input path and the second door of the tray cover to transport the item inputted in the robot to the predetermined storage bin.

In some embodiments, in response to detecting that items in a preset storage bin in a preset tray satisfies an item output condition, the robot transports, through rotation of the space separator in the preset tray, the item in the preset storage bin to the first door of the preset tray, and transports, through opening and closing of the first door of the tray at the each layer corresponding to the first door of the preset tray on an output path, the item in the preset storage bin to the packaging machine.

The robot for sorting according to the embodiments of the present disclosure comprises: at least one layer of trays, wherein the tray at each layer comprises: a shaft provided at an axial center of the tray; the tray is provided with a first slot that has an openable first door, such that items may be outputted downwardly through opening and closing of the first door, which improves output efficiency of the items in the storage bin; an end of the tray extends upwardly to form a tray wall; the tray is provided with at least one space separator for partitioning the storage bin, the space separator being provided along a shaft of the tray till the tray wall; moreover, the space separator may rotate about the shaft of the tray, such that the size of the storage bin and the number of the items placed in the storage bin may be adjusted.

BRIEF DESCRIPTION OF THE DRAWINGS

Other features, objectives and advantages of the present disclosure will become more apparent through reading the detailed description of non-limiting embodiments with reference to the accompanying drawings.

DETAILED DESCRIPTION

Hereinafter, the present disclosure will be described in further detail with reference to the accompanying drawings and the embodiments. It will be appreciated that the preferred embodiments described herein are only for illustration, rather than limiting the present disclosure. In addition, it should also be noted that for the ease of description, the drawings only illustrate those parts related to the present disclosure.

It needs to be noted that without conflicts, the embodiments in the present disclosure and the features in the embodiments may be combined with each other. Hereinafter, the present disclosure will be illustrated in detail with reference to the accompanying drawings in conjunction with the embodiments. Those skilled in the art will also understand that although terms "first" and "second" may be used to describe various kinds of slots, doors, tray servo systems, such slots, doors and tray servo systems should not be limited by these expressions. These terms are only intended for distinguishing one slot, door, and tray servo system from other slot, door, and tray servo system.

Figure 1:
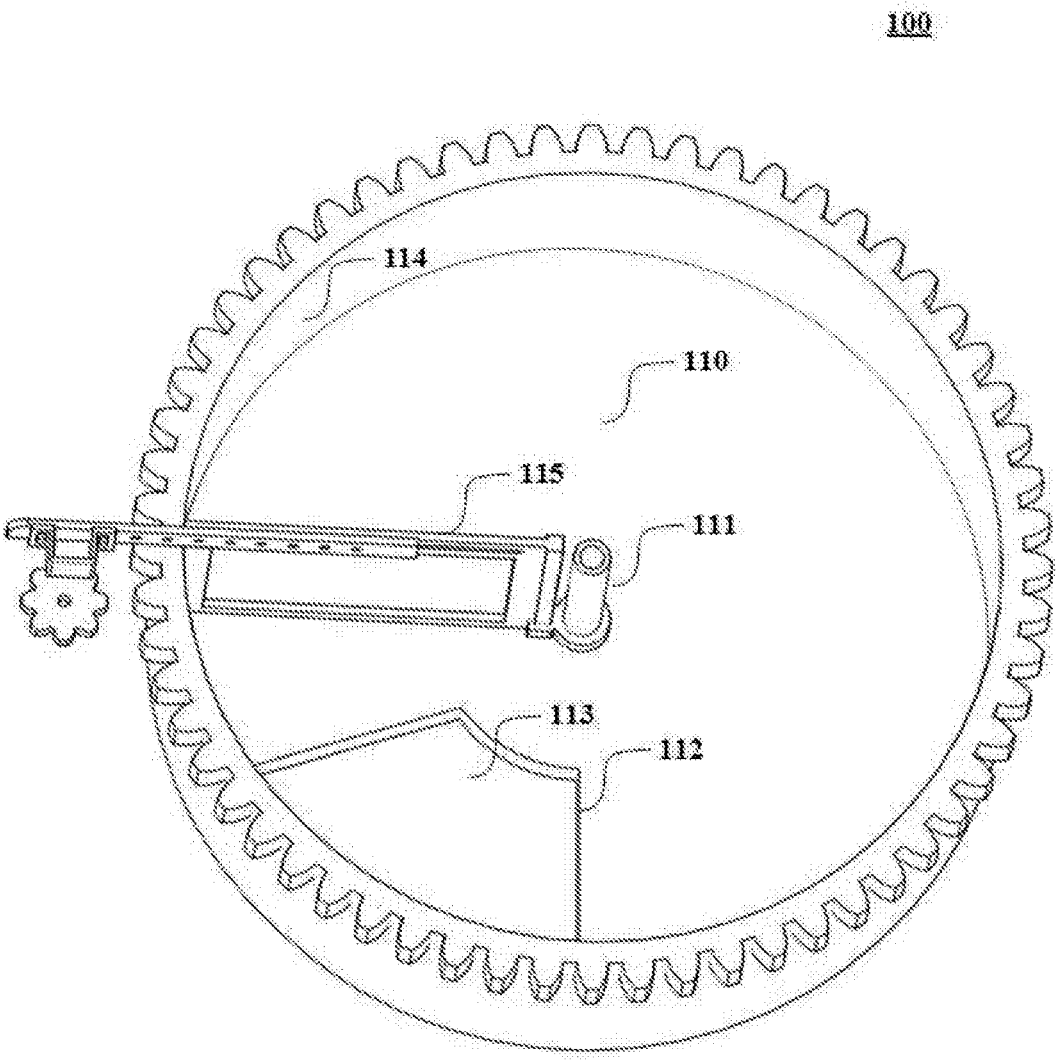
FIG. 1 is an exemplary structural diagram of a first embodiment of a robot for sorting according to the present disclosure.

Please refer to FIG. 1, which shows an exemplary structural diagram of a first embodiment of a robot for sorting according to the present disclosure.

As illustrated in FIG. 1, the robot 100 for sorting may comprise a single layer of tray 110, wherein an axial center of the tray 110 is provided with a shaft 111; the tray is provided with a first slot 112 in which an openable first door 113 is provided; an end of the tray extends upwardly to form a tray wall 114; a space separator 115 for partitioning a storage bin is provided along the shaft 111 of the tray till the tray wall 114; and the space separator 115 is in rotary connection to the shaft 111 of the tray 110 and is rotatable about the shaft 111 of the tray.

In this embodiment, a shape of the first slot 112 provided at the tray 110 may be set according to user needs. For example, it may be set as a square shape, a rectangular shape, a circular shape, or a sector shape, etc. based on a shape of an item to be circulated by the user.

The first door 113 provided in the first slot 112 may be implemented by an existing or a future developed openable automatic door, which is not limited in the present disclosure. For example, the openable automatic door may be implemented using a sliding door driven by a servo motor or an openable automatic door that is driven by a motor and that may be opened through rotation along a door axle.

The space separator 115 may be in rotary connection with the shaft 111 of the tray and designed integrally or separately to implement a space partitioning function. The space separator 115 may adopt a motor or other rotary driving device to drive the space separator to rotate about the shaft 111 of the tray. Here, the space separators may be provided in one or more.

When one space separator 115 is provided, the rotation driving device of the space separator may be provided on the shaft 111 of the tray to which the space separator 115 is connected, or is provided at one end of the space separator 115 immediately adjacent to the tray wall 114.

When more space separators 115 are provided, in light of the fact that respective space separators need to move independently, the rotation driving devices of the space separators 115 may be provided at one end of the tray walls 114 immediately adjacent to the space separators 115.

The robot for sorting provided in the embodiment of the present disclosure outputs items in the storage bin via the first openable door to thereby enhance the output efficiency of the items in the storage bin, and may dynamically configure the size of the storage bin in the tray by rotary connection with one or more space separators on the shaft of the tray.

Figure 2:
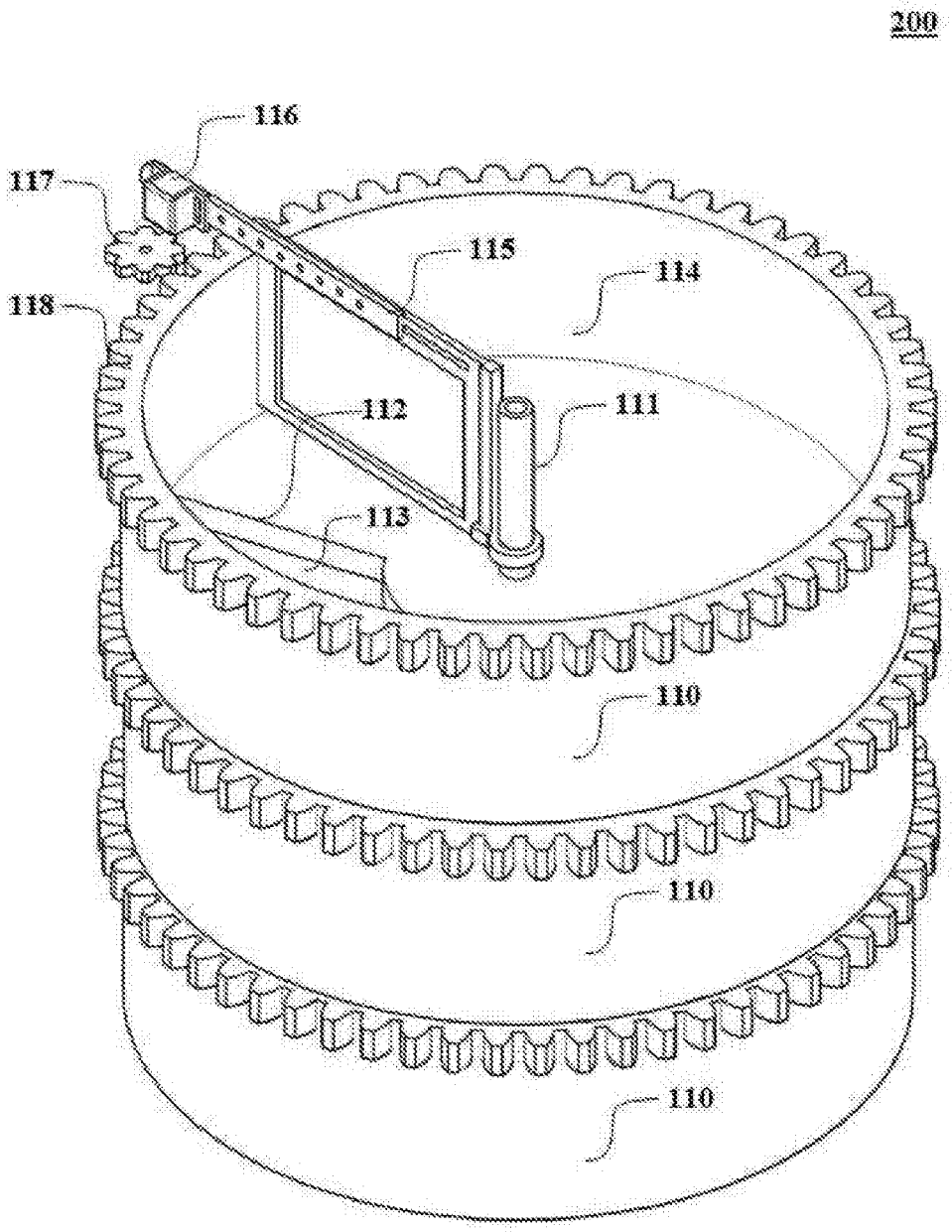
FIG. 2 is an exemplary structural diagram of a second embodiment of a robot for sorting according to the present disclosure.

Further refer to FIG. 2, which is an exemplary structural diagram of a second embodiment of a robot for sorting according to the present disclosure.

As shown in FIG. 2, the robot 200 for sorting comprises: three layers of trays 110, wherein the tray 110 at each layer comprises: a shaft 111 provided at an axial center of the tray 110, the shaft 111 of the tray being a first tray servo system, a shaft of the first tray servo system driving the tray to rotate about the shaft 111 of the tray; the tray 110 is provided with a first slot 112 in which an openable first door 113 is provided, the openable first door 113 being provided with a door servo motor; the door servo motor controls an openness of the first door 113; an end of the tray extends upwardly to form a tray wall 114; a space separator 115 for partitioning a storage bin is provided along the shaft 111 of the tray till the tray wall 114; the space separator 115 is provided with a driving motor 116; a gearwheel 117 is provided on the shaft of the driving motor; when the shaft of the driving motor 116 drives the gearwheel 117 to rotate, the gearwheel 117 is engaged with a gear ring 118 preset on the tray wall, to thereby drive the space separator to rotate about the shaft of the tray.

In this embodiment, the shaft of the tray at the top layer is connected to the shaft of the tray at the bottom layer, i.e., the shaft of the tray at the bottom layer needs to support the shaft of the tray at the top layer; therefore, a model size of the shaft of the tray at the bottom layer could be larger than that of the shaft of the tray at the top layer, or the shaft of the tray at the bottom layer is made of a better material. The shafts of the trays at respective layers may be implemented by first tray servo systems of different models or of the same model, and the trays are driven via the shafts of the first tray servo systems to rotate about the shafts of the trays. Here, the first tray servo system could have an encoder on the shaft for obtaining the rotation angle of the tray.

A shape of the first slot 112 provided at the tray 110 may be set according to user needs. For example, it may be set as a square shape, a rectangular shape, a circular shape, or a sector shape, etc. based on a shape of an item to be circulated by the user.

The first door 113 provided in the first slot 112 may be implemented as an openable automatic door using a sliding door driven by a servo motor.

The space separator 115 designed integrally or separately, may be in rotary connection with the shaft 111 of the tray and to implement a space partitioning function. The space separator 115 may adopt a driving motor to drive the space separator to rotate about the shaft 111 of the tray. Here, the shaft of the driving motor may be provided with a gear 117 and an encoder together for obtaining the rotation angle of the gear 117. Here, the space separators may be provided in one or more. When the tray includes more space separators, a plurality of separators rotates about a shaft of the tray via a mounting ring, respectively.

The ring gear 118 preset on the tray wall may be an inner gear ring or an outer gear ring. FIG. 2 exemplarily shows a scenario in which the gear ring 118 is an outer gear ring, where the driving motor and the gearwheel are disposed at an outer side of the tray wall, and the gearwheel can moves along the outer gear ring. It should be understood that when the gear ring 118 is an inner gear ring, the driving motor and the gearwheel are disposed at an inner side of the tray wall, and the gearwheel will move along the inner gear ring.

In some optional implementations of this embodiment, an output of the first door of the tray at the bottom layer in the three layers of trays corresponds to a packaging machine. specifically, the output of the first door of the tray at the bottom layer in the three layers of trays corresponds to an inlet of a single packaging machine; or through rotation of the tray at the bottom layer in the three layers of trays, the output of the first door of the tray at the bottom layer in the three layers of trays corresponds to inlets of different packaging machines.

In a specific example, when sorting an item using the robot in this embodiment, the robot may identify an inputted item through a detecting and identifying device, and rotates, via the first tray servo system on an input path, the first door of the tray at each layer till above a predetermined storage bin, then controls opening and closing of the first door of the tray at each layer on the input path, and transports the inputted item to the predetermined storage bin. The robot may also transport, in response to detecting that the item in the preset storage bin in the preset tray satisfies an item output condition, the item in the preset storage bin to the first door of the preset tray through rotation of the space separator in the preset tray, and transport, through opening and closing of the first door of the tray at each layer corresponding to the first door of the preset tray on an output path, the item in the storage bin to the packaging machine.

The robot for sorting provided according to the embodiment of the present disclosure may provide a driving machine at the tray wall side of the space separator and provide a gearwheel on the shaft of the drive motor, wherein the gearwheel is engageable with the gear ring preset on the tray wall, such that the driving motor drives the gear to engage with the gear ring and the space separator rotates about the shaft of the tray; in this way, the size of the storage bin may be adjusted; further, the position corresponding to the first door of the tray at each layer may be adjusted through the first tray servo system of the tray at each layer, thereby facilitating inputting or outputting an item from the first door.

Figure 3:
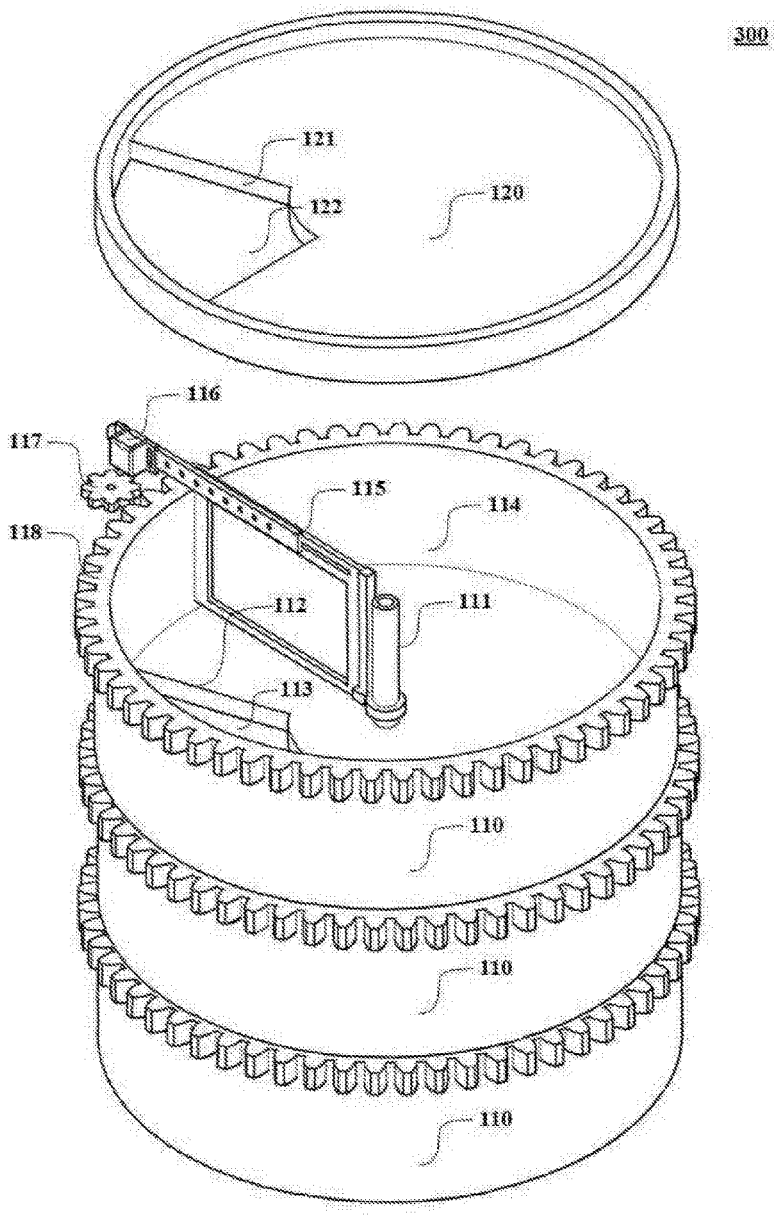
FIG. 3 is an exemplary structural diagram of a third embodiment of a robot for sorting according to the present disclosure.

Further refer to FIG. 3, which is an exemplary structural diagram of a third embodiment of a robot for sorting according to the present disclosure.

As shown in FIG. 3, the robot 300 for sorting may comprise: three layers of trays 110 and a tray cover 120; wherein the tray 110 at each layer comprises: a shaft 111 provided at an axial center of the tray 110, the shaft 111 of the tray being a first tray servo system, a shaft of the first tray servo system driving the tray to rotate about the shaft 111 of the tray; the tray 110 is provided with a first slot 112 in which an openable first door 113 is provided, the openable first door 113 being provided with a door servo motor; the door servo motor controls an openness of the first door 113; an end of the tray extends upwardly to form a tray wall 114; a space separator 115 for partitioning a storage bin is provided along the shaft 111 of the tray till the tray wall 114; the space separator 115 is provided with a driving motor 116; a gearwheel 117 is provided on the shaft of the driving motor; when the shaft of the driving motor 116 drives the gearwheel 117 to rotate, the gearwheel 117 is engaged with a gear ring 118 preset on the tray wall to thereby drive the space separator to rotate about the shaft of the tray; the tray cover 120 is provided above the tray at the top layer in the three layers of trays; an axial center of the tray cover 120 is provided with a second tray servo system; a shaft of the second tray servo system drives the tray cover 120 to rotate about the axial center of the tray cover 120; the tray cover 120 is provided with the second slot 121 in which a second door 122 is provided.

In this embodiment, the shaft of the tray at the top layer is connected to the shaft of the tray at the bottom layer, i.e., the shaft of the tray at the bottom layer needs to support the shaft of the tray at the top layer; therefore, a model size of the shaft of the tray at the bottom layer could be larger than that of the shaft of the tray at the top layer, or the shaft of the tray at the bottom layer is made of a better material. The shafts of the trays at respective layers may be implemented by first tray servo systems of different models or of the same model, and the trays are driven via the shafts of the first tray servo systems to rotate about the shafts of the trays. The shape and size of the tray cover 120 are fit to the shape and size of the tray 110, respectively. Here, the first tray servo system could have an encoder on the shaft for obtaining the rotation angle of the tray. An encoder may also be provided on the shaft of the second tray servo system for obtaining the rotation angle of the tray cover.

A shape of the first slot 112 provided at the tray 110 may be set according to user needs. For example, it may be set as a square shape, a rectangular shape, a circular shape, or a sector shape, etc. based on a shape of an item to be circulated by the user. To be adapted to the first slot 112 of the tray 110, the shape of the second slot 121 provided by the tray cover 120 may also be set according to user needs. For example, the shape of the second slot 121 may be identical to the shape of the first slot 112, based on a shape of an item to be circulated by the user, as a square shape, a rectangular shape, a circular shape, or a sector shape, etc.

The first door 113 provided in the first slot 112 of the tray 110 may be implemented as an openable automatic door using a sliding door driven by a servo motor. The door 122 provided in the slot 121 of the tray cover 120 may also implement an openable automatic door using a sliding door driven by the servo motor. The shape, size and driving manner of the second door may be identical to or different from the shape, size, and driving manner of the first door 113, which is not limited in this disclosure.

The space separator 115 designed integrally or separately, may be in rotary connection with the shaft 111 of the tray and to implement a space partitioning function. The space separator 115 may adopt a driving motor to drive the space separator to rotate about the shaft 111 of the tray. Here, the shaft of the driving motor may be provided with a gear 117 and an encoder together for obtaining the rotation angle of the gear 117. Here, the space separators may be provided in one or more. When the tray includes more space separators, a plurality of separators rotates about a shaft of the tray via a mounting ring, respectively.

The ring gear 118 preset on the tray wall may be an inner gear ring or an outer gear ring. FIG. 3 exemplarily shows a scenario in which the gear ring 118 is an outer gear ring, where the driving motor and the gearwheel are disposed at an outer side of the tray wall, and the gearwheel can moves along the outer gear ring. It should be understood that when the gear ring 118 is an inner gear ring, the driving motor and the gearwheel are disposed at an inner side of the tray wall, and the gearwheel will move along the inner gear ring.

In some optional implementations of this embodiment, an output of the first door of the tray at the bottom layer in the three layers of trays corresponds to a packaging machine. Specifically, the output of the first door of the tray at the bottom layer in the three layers of trays corresponds to an inlet of a single packaging machine; or through rotation of the tray at the bottom layer in the three layers of trays, the output of the first door of the tray at the bottom layer in the three layers of trays corresponds to inlets of different packaging machines.

In a specific example, when sorting an item using the robot in this embodiment, the robot may identify an inputted item through a detecting and identifying device, and rotates, via the first tray servo system of the tray at each layer on the input path and the second tray servo system of the tray cover, the first door of the tray at each layer and the second door of the tray cover till above a predetermined storage bin, respectively, then controls opening and closing of the first door of the tray at each layer on the input path and the second door of the tray cover, and transports the item inputted to the robot to the predetermined storage bin. In response to detecting that the item in the preset storage bin in the preset tray satisfies an item output condition, the robot may also transport the item in the preset storage bin to the first door of the preset tray through rotation of the space separator in the preset tray, and transport the item in the storage bin to the packaging machine through opening and closing of the first door of the tray at each layer corresponding to the first door of the preset tray on an output path.

The robot for sorting provided according to the embodiment of the present disclosure may provide a driving machine at the tray wall side of the space separator and provide a gearwheel on the shaft of the drive motor, wherein the gearwheel is engageable with the gear ring preset on the tray wall, such that the driving motor drives the gear to move along the gear ring; and in this way, the size of the storage bin may be adjusted by the space separator, and the position corresponding to the first door of the tray at each layer and the position corresponding to the second door of the tray cover may be adjusted through the first tray servo system of the tray at each layer and the second tray servo system of the tray cover; consequently, the efficiency of the robot in inputting the item into the predetermined storage bin may be improved, and the efficiency of outputting the item from the preset storage bin may be improved.

What have been described above are only preferred embodiments of the present disclosure and an illustration of the technical principle as exerted. Those skilled in the art should understand, the scope of the invention in the present disclosure is not limited to the technical solution resulting from a specific combination of the technical features, and meanwhile, should also cover other technical solutions resulting from any combination of the technical features or their equivalent features without departing from the inventive concept. For example, a technical solution resulting from mutual substitution of the features and those technical features disclosed (not limited to) in the present disclosure with similar functions.

What is claimed is:

1. A robot for sorting comprising:

at least one layer of trays, wherein each tray at each layer comprises:

a shaft provided at an axial center of the tray;

a first slot provided at the tray, in which first slot an openable first door is provided;

an end of the tray extends upwardly to form a tray wall;

at least one space separator for partitioning a storage bin is provided along the shaft of the tray till the tray wall; and the space separator is in rotary connection to the shaft of the tray and is rotatable about the shaft of the tray, wherein the robot is configured to, in response to identifying an input item or a stored item satisfying an item output condition:

rotate the first door of the tray at each layer through the shaft of the tray located at each layer of the tray, and control opening and closing of the first door of the tray at each layer to transport the input item or the stored item to a destination position.

2. The robot according to claim 1, wherein the shaft of the tray is a first tray servo system, and a shaft of the first tray servo system drives the tray to rotate about the shaft of the tray.

3. The robot according to claim 1, wherein the space separator is provided with a driving motor;

a gearwheel is provided on a shaft of the driving motor; and when the shaft of the driving motor drives the gearwheel to rotate, the gearwheel is engaged with a gear ring preset on the tray wall to drive the space separator to rotate about the shaft of the tray.

4. The robot according to claim 1, wherein the openable first door is provided with a door servo motor that controls an openness of the first door.

5. The robot according to claim 1, wherein an output of the first door of the tray at a bottom layer in the at least one layer of trays corresponds to a packaging machine.

6. The robot according to claim 5, wherein an output of the first door of the tray at the bottom layer in the at least one layer of trays corresponds to an inlet of a single packaging machine; or through rotation of the tray at the bottom layer in the at least one layer of trays, the output of the first door of the tray at the bottom layer corresponds to inlets of different packaging machines.

7. The robot according to claim 2, wherein the robot further comprises: a tray cover concentric with the shaft of the tray, wherein the tray cover is disposed above a tray at a top layer in the at least one layer of trays;

an axial center of the tray cover is provided with a second tray servo system;

a shaft of the second tray servo system drives the tray cover to rotate about the axial center of the tray cover; and the tray cover is provided with a second slot in which an openable second door is provided.

8. The robot according to claim 3, wherein the robot further comprises: a tray cover concentric with the shaft of the tray, wherein the tray cover is disposed above a tray at a top layer in the at least one layer of trays;

an axial center of the tray cover is provided with a second tray servo system;

a shaft of the second tray servo system drives the tray cover to rotate about the axial center of the tray cover; and the tray cover is provided with a second slot in which an openable second door is provided.

9. The robot according to claim 5, wherein the robot further comprises: a tray cover concentric with the shaft of the tray, wherein the tray cover is disposed above a tray at a top layer in the at least one layer of trays;

an axial center of the tray cover is provided with a second tray servo system;

a shaft of the second tray servo system drives the tray cover to rotate about the axial center of the tray cover; and the tray cover is provided with a second slot in which an openable second door is provided.

10. The robot according to claim 6, wherein the robot further comprises: a tray cover concentric with the shaft of the tray, wherein the tray cover is disposed above a tray at a top layer in the at least one layer of trays;

an axial center of the tray cover is provided with a second tray servo system;

a shaft of the second tray servo system drives the tray cover to rotate about the axial center of the tray cover; and the tray cover is provided with a second slot in which an openable second door is provided.

11. The robot according to claim 2, wherein the robot is configured to identify the input item by a detecting and identifying device, and to rotate, through the first tray servo system located at each layer of the tray on an input path, the first door of the tray at each layer till above a predetermined storage bin, and to control opening and closing of the first door of the tray at each layer located on the input path to transport the inputted item to the predetermined storage bin.

12. The robot according to claim 7, wherein the robot is configured to identify the input item by a detecting and identifying device, and to rotate, via the first tray servo system of the tray at each layer on the input path and the second tray servo system of the tray cover, the first door of the tray at each layer and the second door of the tray cover till above the predetermined storage bin, respectively, and to control opening and closing of the first door of the tray at each layer on the input path and the second door of the tray cover to transport the item inputted in the robot to the predetermined storage bin.

13. The robot according to claim 8, wherein the robot is configured to identify the input item by a detecting and identifying device, and to rotate, via the first tray servo system of the tray at each layer on the input path and the second tray servo system of the tray cover, the first door of the tray at each layer and the second door of the tray cover till above the predetermined storage bin, respectively, and to control opening and closing of the first door of the tray at each layer on the input path and the second door of the tray cover to transport the item inputted in the robot to the predetermined storage bin.

14. The robot according to claim 9, wherein the robot is configured to identify the input item by a detecting and identifying device, and to rotate, via the first tray servo system of the tray at each layer on the input path and the second tray servo system of the tray cover, the first door of the tray at each layer and the second door of the tray cover till above the predetermined storage bin, respectively, and to control opening and closing of the first door of the tray at each layer on the input path and the second door of the tray cover to transport the item inputted in the robot to the predetermined storage bin.

15. The robot according to claim 10, wherein the robot is configured to identify the input item by a detecting and identifying device, and to rotate, via the first tray servo system of the tray at each layer on the input path and the second tray servo system of the tray cover, the first door of the tray at each layer and the second door of the tray cover till above the predetermined storage bin, respectively, and to control opening and closing of the first door of the tray at each layer on the input path and the second door of the tray cover to transport the item inputted in the robot to the predetermined storage bin.

16. The robot according to claim 2, wherein in response to detecting that an item in a preset storage bin in a preset tray satisfies the item output condition, the robot is configured to transport, through rotation of the space separator in the preset tray, the item in the preset storage bin to the first door of the preset tray, and to transport, through opening and closing of the first door of the tray at each layer corresponding to the first door of the preset tray on an output path, the item in the preset storage bin to the packaging machine.

17. The robot according to claim 11, wherein in response to detecting that an item in a preset storage bin in a preset tray satisfies the item output condition, the robot is configured to transport, through rotation of the space separator in the preset tray, the item in the preset storage bin to the first door of the preset tray, and to transport, through opening and closing of the first door of the tray at each layer corresponding to the first door of the preset tray on an output path, the item in the preset storage bin to the packaging machine.

18. The robot according to claim 12, wherein in response to detecting that an item in a preset storage bin in a preset tray satisfies the item output condition, the robot is configured to transport, through rotation of the space separator in the preset tray, the item in the preset storage bin to the first door of the preset tray, and to transport, through opening and closing of the first door of the tray at each layer corresponding to the first door of the preset tray on an output path, the item in the preset storage bin to the packaging machine.

19. The robot according to claim 13, wherein in response to detecting that an item in a preset storage bin in a preset tray satisfies the item output condition, the robot is configured to transport, through rotation of the space separator in the preset tray, the item in the preset storage bin to the first door of the preset tray, and to transport, through opening and closing of the first door of the tray at each layer corresponding to the first door of the preset tray on an output path, the item in the preset storage bin to the packaging machine.

20. The robot according to claim 14, wherein in response to detecting that an item in a preset storage bin in a preset tray satisfies the item output condition, the robot is configured to transport, through rotation of the space separator in the preset tray, the item in the preset storage bin to the first door of the preset tray, and to transport, through opening and closing of the first door of the tray at each layer corresponding to the first door of the preset tray on an output path, the item in the preset storage bin to the packaging machine.

* * * * *